US009877103B2

(12) United States Patent
Litovsky et al.

(10) Patent No.: US 9,877,103 B2
(45) Date of Patent: Jan. 23, 2018

(54) ACOUSTIC DEVICE

(71) Applicant: Bose Corporation, Framingham, MA (US)

(72) Inventors: Roman N. Litovsky, Newton, MA (US); Bojan Rip, Newton, MA (US); Joseph M. Geiger, Clinton, MA (US); Chester Smith Williams, Lexington, MA (US); Pelham Norville, Framingham, MA (US); Brandon Westley, Hopkinton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/220,535

(22) Filed: Jul. 27, 2016

(65) Prior Publication Data

US 2016/0337747 A1 Nov. 17, 2016

Related U.S. Application Data

(63) Continuation-in-part of application No. 14/799,265, filed on Jul. 14, 2015, now Pat. No. 9,571,917.

(60) Provisional application No. 62/026,237, filed on Jul. 18, 2014.

(51) Int. Cl.

| | |
|---|---|
| ***H04R 25/00*** | (2006.01) |
| ***H04R 1/28*** | (2006.01) |
| ***H04R 5/033*** | (2006.01) |
| *H04R 1/10* | (2006.01) |

(52) U.S. Cl.

CPC ..... *H04R 1/2838* (2013.01); *H04R 1/2853* (2013.01); *H04R 5/0335* (2013.01); *H04R 1/105* (2013.01)

(58) Field of Classification Search

CPC .... H04R 1/2838; H04R 1/2853; H04R 1/105; H04R 5/0335

See application file for complete search history.

(56) References Cited

U.S. PATENT DOCUMENTS

| | | | | |
|---|---|---|---|---|
| 5,617,477 | A | 4/1997 | Boyden | |
| 5,682,434 | A | 10/1997 | Boyden | |
| 6,301,367 | B1 | 10/2001 | Boyden et al. | |
| 9,100,732 | B1 | 8/2015 | Dong et al. | |
| 9,159,312 | B1 * | 10/2015 | Tom | G10K 11/175 |

(Continued)

FOREIGN PATENT DOCUMENTS

| | | | |
|---|---|---|---|
| WO | 95/34184 | A1 | 12/1995 |
| WO | 2016/011063 | A1 | 1/2016 |

OTHER PUBLICATIONS

The International Search Report and the Written Opinion dated Jan. 2, 2017 for PCT Application No. PCT/US2016/051923.

(Continued)

*Primary Examiner* — Tuan D Nguyen
(74) *Attorney, Agent, or Firm* — Brian M. Dingman; Dingman IP Law, PC

(57) ABSTRACT

An acoustic device that has a neck loop that is constructed and arranged to be worn around the neck. The neck loop includes a housing with a first acoustic waveguide having a first sound outlet opening, and a second acoustic waveguide having a second sound outlet opening. There is a first open-backed acoustic driver acoustically coupled to the first waveguide and a second open-backed acoustic driver acoustically coupled to the second waveguide.

19 Claims, 14 Drawing Sheets

(56) References Cited

U.S. PATENT DOCUMENTS

| | | | | |
|---|---|---|---|---|
| 2007/0258613 | A1 | 11/2007 | Wright | |
| 2010/0185432 | A1 | 7/2010 | Almagro | |
| 2015/0088500 | A1* | 3/2015 | Conliffe ..... | G02C 11/10<br>704/235 |
| 2016/0021446 | A1 | 1/2016 | Litovsky et al. | |
| 2016/0021449 | A1 | 1/2016 | Litovsky et al. | |

OTHER PUBLICATIONS

The International Search Report and the Written Opinion dated Sep. 27, 2017 for PCT Application No. PCT/US2017/044069.

* cited by examiner

ACOUSTIC DEVICE

CROSS-REFERENCE TO RELATED APPLICATION

This application is a continuation-in-part of U.S. patent application Ser. No. 14/799,265, filed on Jul. 14, 2015, which claims benefit from U.S. Provisional Patent Application No. 62/026,237, filed on Jul. 18, 2014, the entire contents of which are incorporated herein by reference.

BACKGROUND

This disclosure relates to an acoustic device.

Headsets have acoustic drivers that sit on, over or in the ear. They are thus somewhat obtrusive to wear, and can inhibit the user's ability to hear ambient sounds.

SUMMARY

All examples and features mentioned below can be combined in any technically possible way.

The present acoustic device directs high quality sound to each ear without acoustic drivers on, over or in the ears. The acoustic device is designed to be worn around the neck. The acoustic device may comprise a neck loop with a housing. The neck loop may have a "horseshoe"-like, or generally "U" shape, with two legs that sit over or near the clavicles and a curved central portion that sits behind the neck. The acoustic device may have two acoustic drivers; one on each leg of the housing. The drivers may be located below the expected locations of the ears of the user, with their acoustic axes pointed at the ears. The acoustic device may further include two waveguides within the housing, each one having an exit below an ear, close to a driver. The rear side of one driver may be acoustically coupled to the entrance to one waveguide and the rear side of the other driver may be acoustically coupled to the entrance to the other waveguide. Each waveguide may have one end with the driver that feeds it located below one ear (left or right), and the other end (the open end) located below the other ear (right or left), respectively.

The waveguides may fold over one another within the housing. The waveguides may be constructed and arranged such that the entrance and exit to each one is located at the top side of the housing. The waveguides may be constructed and arranged such that each one has a generally consistent cross-sectional area along its length. The waveguides may be constructed and arranged such that each one begins just behind one driver, runs down along the top portion of the housing in the adjacent leg of the neck loop to the end of the leg, turns down to the bottom portion of the housing and turns 180 degrees to run back up the leg, then across the central portion and back down the top portion of the other leg, to an exit located just posteriorly of the other driver. Each waveguide may flip position from the bottom to the top portion of the housing in the central portion of the neck loop.

In one aspect, an acoustic device includes a neck loop that is constructed and arranged to be worn around the neck. The neck loop includes a housing with comprises a first acoustic waveguide having a first sound outlet opening, and a second acoustic waveguide having a second sound outlet opening. There is a first open-backed acoustic driver acoustically coupled to the first waveguide and a second open-backed acoustic driver acoustically coupled to the second waveguide.

Embodiments may include one of the following features, or any combination thereof. The first and second acoustic drivers may be driven such that they radiate sound that is out of phase, over at least some of the spectrum. The first open-backed acoustic driver may be carried by the housing and have a first sound axis that is pointed generally at the expected location of one ear of the user, and the second open-backed acoustic driver may also be carried by the housing and have a second sound axis that is pointed generally at the expected location of the other ear of the user. The first sound outlet opening may be located proximate to the second acoustic driver and the second sound outlet opening may be located proximate to the first acoustic driver. Each waveguide may have one end with its corresponding acoustic driver located at one side of the head and in proximity to and below the adjacent ear, and another end that leads to its sound outlet opening, located at the other side of the head and in proximity to and below the other, adjacent ear.

Embodiments may include one of the above or the following features, or any combination thereof. The housing may have an exterior wall, and the first and second sound outlet openings may be defined in the exterior wall of the housing. The waveguides may both be defined by the exterior wall of the housing and an interior wall of the housing. The interior wall of the housing may lie along a longitudinal axis that is twisted 180° along its length. The neck loop may be generally "U"-shaped with a central portion and first and second leg portions that depend from the central portion and that have distal ends that are spaced apart to define an open end of the neck loop, wherein the twist in the housing interior wall is located in the central portion of the neck loop. The interior wall of the housing may be generally flat and lie under both sound outlet openings. The interior wall of the housing may comprise a raised sound diverter underneath each of the sound outlet openings. The housing may have a top that faces the ears when worn by the user, and wherein the first and sound outlet openings are defined in the top of the housing.

Embodiments may include one of the above or the following features, or any combination thereof. The housing may have a top portion that is closest to the ears when worn by the user and a bottom portion that is closest to the torso when worn by the user, and each waveguide may lie in part in the top portion of the housing and in part in the bottom portion of the housing. The neck loop may be generally "U"-shaped with a central portion and first and second leg portions that depend from the central portion and that have distal ends that are spaced apart to define an open end of the neck loop. The twist in the housing interior wall may be located in the central portion of the neck loop. The first acoustic driver may be located in the first leg portion of the neck loop and the second acoustic driver may be located in the second leg portion of the neck loop. The first waveguide may begin underneath the first acoustic driver, extend along the top portion of the housing to the distal end of the first leg portion of the neck loop and turn to the bottom portion of the housing and extend along the first leg portion into the central portion of the neck loop where it turns to the top portion of the housing and extends into the second leg portion to the first sound outlet opening. The second waveguide may begin underneath the second acoustic driver, extend along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

In another aspect an acoustic device includes a neck loop that is constructed and arranged to be worn around the neck, the neck loop comprising a housing that comprises a first acoustic waveguide having a first sound outlet opening, and a second acoustic waveguide having a second sound outlet opening, a first open-backed acoustic driver acoustically coupled to the first waveguide, where the first open-backed acoustic driver is carried by the housing and has a first sound axis that is pointed generally at the expected location of one ear of the user, a second open-backed acoustic driver acoustically coupled to the second waveguide, where the second open-backed acoustic driver is carried by the housing and has a second sound axis that is pointed generally at the expected location of the other ear of the user, wherein the first sound outlet opening is located proximate to the second acoustic driver and the second sound outlet opening is located proximate to the first acoustic driver, and wherein the first and second acoustic drivers are driven such that they radiate sound that is out of phase.

Embodiments may include one of the following features, or any combination thereof. The waveguides may both be defined by the exterior wall of the housing and an interior wall of the housing, and wherein the interior wall of the housing lies along a longitudinal axis that is twisted 180° along its length. The neck loop may be generally "U"-shaped with a central portion and first and second leg portions that depend from the central portion and that have distal ends that are spaced apart to define an open end of the neck loop, wherein the twist in the housing interior wall is located in the central portion of the neck loop. The housing may have a top portion that is closest to the ears when worn by the user and a bottom portion that is closest to the torso when worn by the user, and wherein each waveguide lies in part in the top portion of the housing and in part in the bottom portion of the housing.

In another aspect an acoustic device includes a neck loop that is constructed and arranged to be worn around the neck, the neck loop comprising a housing that comprises a first acoustic waveguide having a first sound outlet opening, and a second acoustic waveguide having a second sound outlet opening, wherein the waveguides are both defined by the exterior wall of the housing and an interior wall of the housing, and wherein the interior wall of the housing lies along a longitudinal axis that is twisted 180° along its length, wherein the neck loop is generally "U"-shaped with a central portion and first and second leg portions that depend from the central portion and that have distal ends that are spaced apart to define an open end of the neck loop, wherein the twist in the housing interior wall is located in the central portion of the neck loop, wherein the housing has a top portion that is closest to the ears when worn by the user and a bottom portion that is closest to the torso when worn by the user, and wherein each waveguide lies in part in the top portion of the housing and in part in the bottom portion of the housing. There is a first open-backed acoustic driver acoustically coupled to the first waveguide, where the first open-backed acoustic driver is located in the first leg portion of the neck loop and has a first sound axis that is pointed generally at the expected location of one ear of the user. There is a second open-backed acoustic driver acoustically coupled to the second waveguide, where the second open-backed acoustic driver is located in the second leg portion of the neck loop and has a second sound axis that is pointed generally at the expected location of the other ear of the user. The first and second acoustic drivers are driven such that they radiate sound that is out of phase. The first sound outlet opening is located proximate to the second acoustic driver and the second sound outlet opening is located proximate to the first acoustic driver. The first waveguide begins underneath the first acoustic driver, extends along the top portion of the housing to the distal end of the first leg portion of the neck loop where it turns to the bottom portion of the housing and extends along the first leg portion into the central portion of the neck loop where it turns to the top portion of the housing and extends into the second leg portion to the first sound outlet opening, and the second waveguide begins underneath the second acoustic driver, extends along the top portion of the housing to the distal end of the second leg portion of the neck loop where it turns to the bottom portion of the housing and extends along the second leg portion into the central portion of the neck loop where it turns to the top portion of the housing and extends into the first leg portion to the second sound outlet opening.

DETAILED DESCRIPTION

Figure 1:
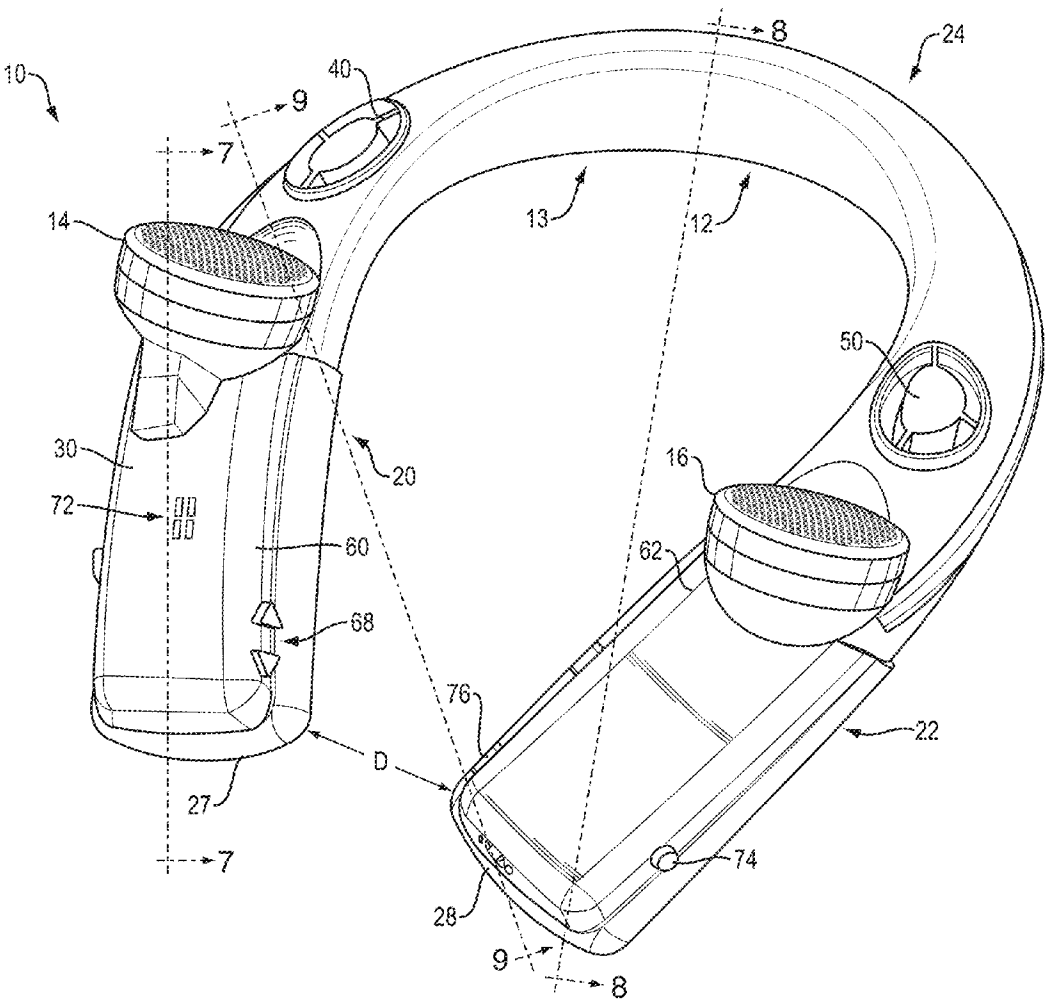
FIG. 1 is top perspective view of an acoustic device.

The acoustic device directs high quality sound to the ears without direct contact with the ears, and without blocking ambient sounds. The acoustic device is unobtrusive, and can be worn under (if the clothing is sufficiently acoustically transparent) or on top of clothing.

In one aspect, the acoustic device is constructed and arranged to be worn around the neck. The acoustic device has a neck loop that includes a housing. The neck loop has a horseshoe-like shape, with two legs that sit over the top of the torso on either side of the neck, and a curved central portion that sits behind the neck. The device has two acoustic drivers one on each leg of the housing. The drivers are located below the expected locations of the ears of the user, with their acoustic axes pointed at the ears. The acoustic device also has two waveguides within the housing, each one having an exit below an ear, close to a driver. The rear side of one driver is acoustically coupled to the entrance to one waveguide and the rear side of the other driver is acoustically coupled to the entrance to the other waveguide. Each waveguide has one end with the driver that feeds it located below one ear (left or right), and the other end (the open end) located below the other ear (right or left), respectively.

A non-limiting example of the acoustic device is shown in the drawings. This is but one of many possible examples that would illustrate the subject acoustic device. The scope of the invention is not limited by the example but rather is supported by the example.

Figure 2:
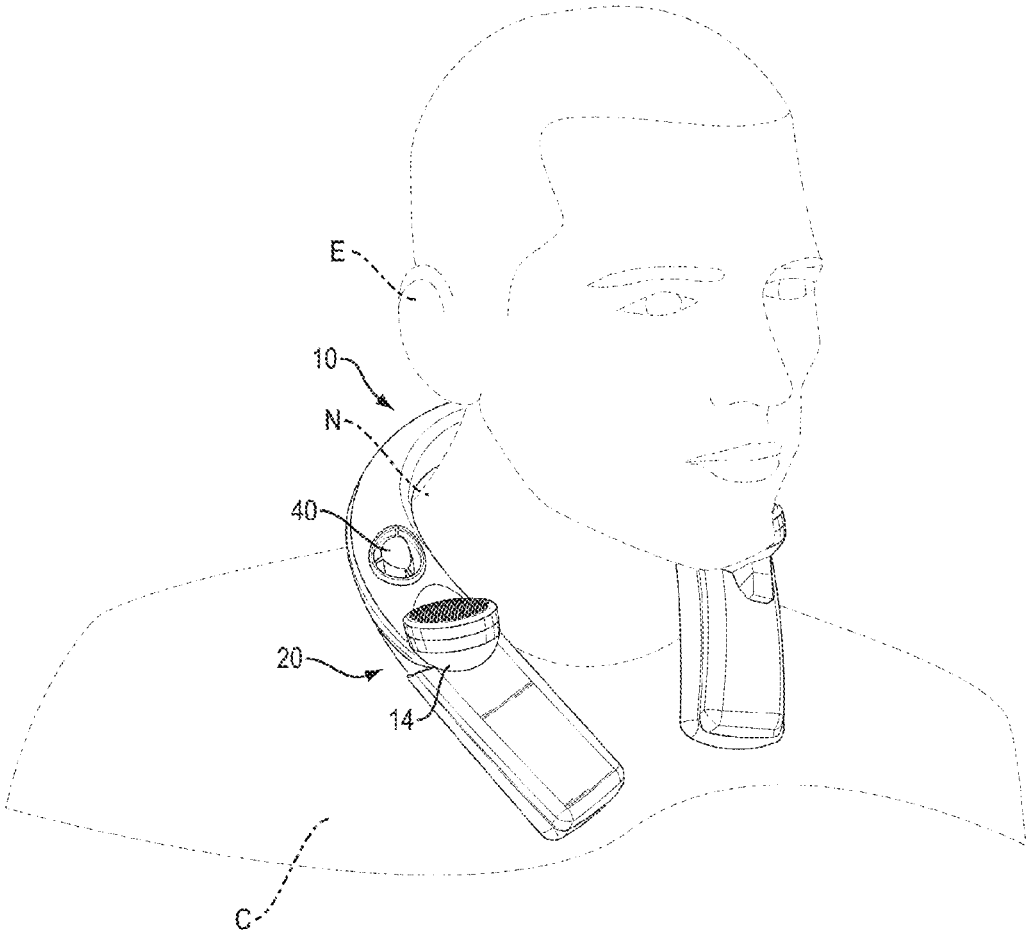
FIG. 2 is top perspective view of the acoustic device being worn by a user.
Figure 3:
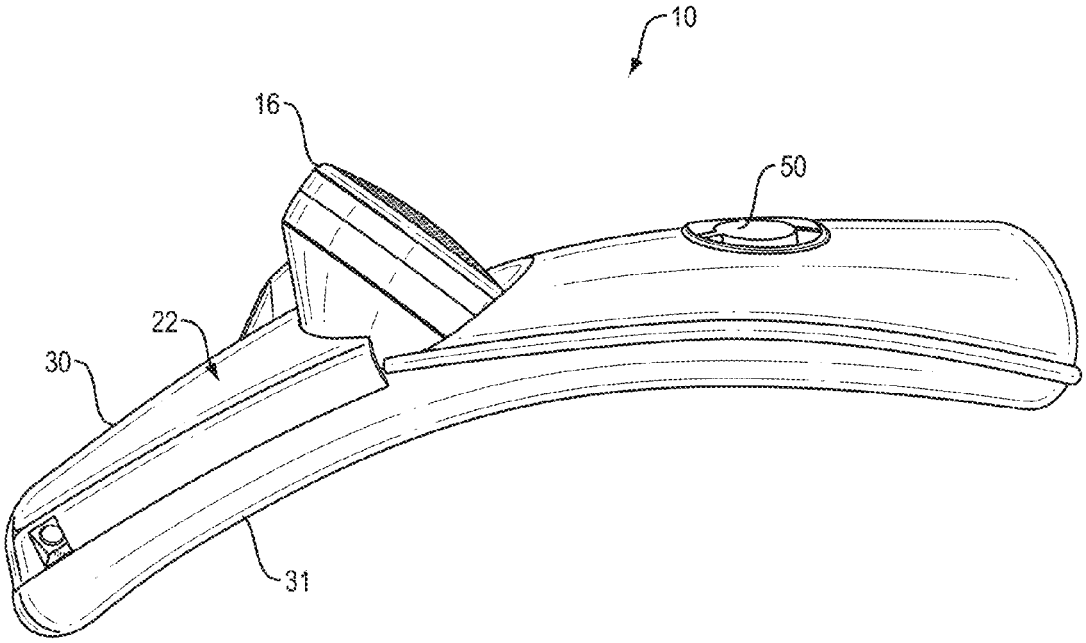
FIG. 3 is a right side view of the acoustic device.
Figure 4:
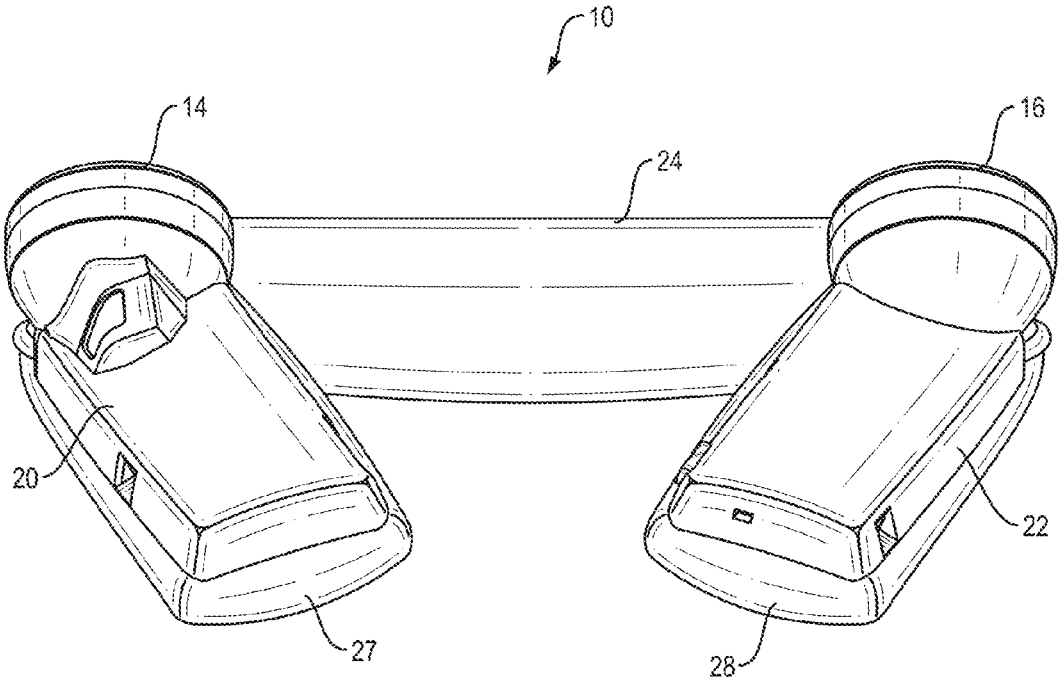
FIG. 4 is front view of the acoustic device.
Figure 5:
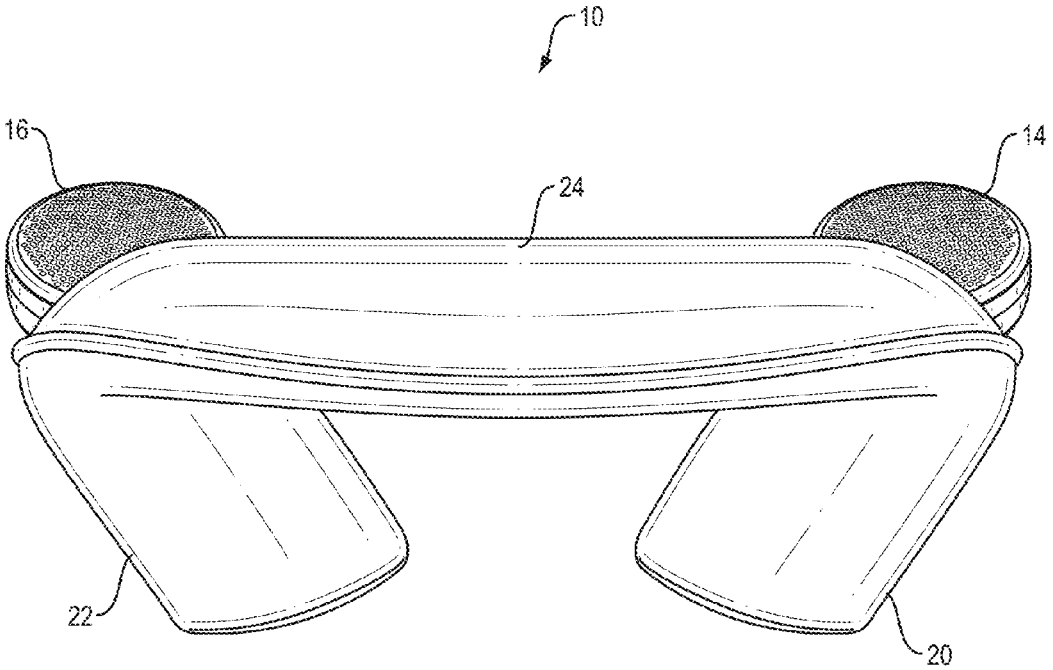
FIG. 5 is a rear view of the acoustic device.
Figure 6:
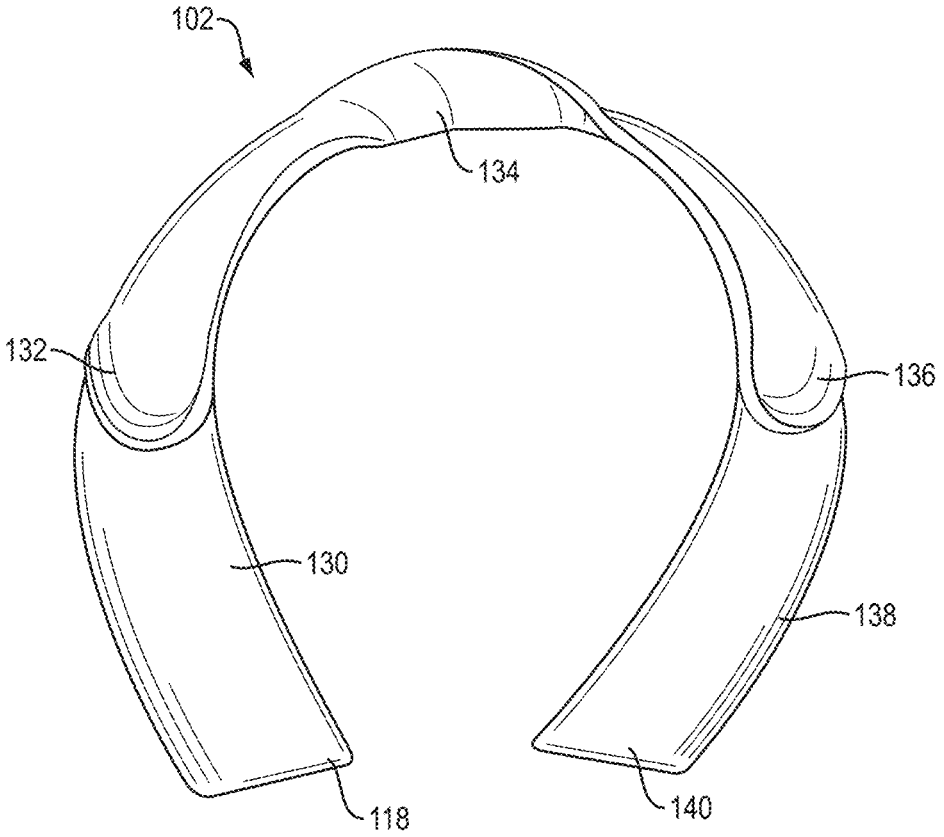
FIG. 6 is top perspective view of the interior septum or wall of the housing of the acoustic device.

Acoustic device 10 (FIGS. 1-9) includes a horseshoe-shaped (or, perhaps, generally "U"-shaped) neck loop 12 that is shaped, constructed and arranged such that it can be worn around the neck of a person, for example as shown in FIG. 2. Neck loop 12 has a curved central portion 24 that will sit at the nape of the neck "N", and right and left legs 20 and 22, respectively, that depend from central portion 24 and are constructed and arranged to drape over the upper torso on either side of the neck, generally over or near the clavicle "C." FIGS. 3-5 illustrate the overall form that helps acoustic device 10 to drape over and sit comfortably on the neck and upper chest areas.

Neck loop 12 comprises housing 13 that is in essence an elongated (solid or flexible) mostly hollow solid plastic tube (except for the sound inlet and outlet openings), with closed distal ends 27 and 28. Housing 13 is divided internally by integral wall (septum) 102. Two internal waveguides are defined by the external walls of the housing and the septum. Housing 13 should be stiff enough such that the sound is not substantially degraded as it travels through the waveguides. In the present non-limiting example, where the lateral distance "D" between the ends 27 and 28 of right and left neck loop legs 20 and 22 is less than the width of a typical human neck, the neck loop also needs to be sufficiently flexible such that ends 27 and 28 can be spread apart when device 10 is donned and doffed, yet will return to its resting shape shown in the drawings. One of many possible materials that has suitable physical properties is polyurethane. Other materials could be used. Also, the device could be constructed in other manners. For example, the device housing could be made of multiple separate portions that were coupled together, for example using fasteners and/or adhesives. And, the neck loop legs do not need to be arranged such that they need to be spread apart when the device is placed behind the neck with the legs draped over the upper chest.

Housing 13 carries right and left acoustic drivers 14 and 16. The drivers are located at the top surface 30 of housing 13, and below the expected location of the ears "E." See FIG. 2. Housing 13 has lower surface 31. The drivers may be canted or angled backwards (posteriorly) as shown, as may be needed to orient the acoustic axes of the drivers (not shown in the drawings) generally at the expected locations of the ears of the wearer/user. The drivers may have their acoustic axes pointed at the expected locations of the ears. Each driver may be about 10 cm from the expected location of the nearest ear, and about 26 cm from the expected location of the other ear (this distance measured with a flexible tape running under the chin up to the most distant ear). The lateral distance between the drivers is about 15.5 cm. This arrangement results in a sound pressure level (SPL) from a driver about three times greater at the closer ear than the other ear, which helps to maintain channel separation.

Located close to and just posteriorly of the drivers and in the top exterior wall 30 of housing 13 are waveguide outlets 40 and 50. Outlet 50 is the outlet for waveguide 110 which has its entrance at the back of right-side driver 14. Outlet 40 is the outlet for waveguide 160 which has its entrance at the back of left-side driver 16. See FIGS. 7-9. Accordingly, each ear directly receives output from the front of one driver and output from the back of the other driver. If the drivers are driven out of phase, the two acoustic signals received by each ear are virtually in phase below the fundamental waveguide quarter wave resonance frequency, that in the present non-limiting example is about 130-360 Hz. This ensures that low frequency radiation from each driver and the same side corresponding waveguide outlet, are in phase and do not cancel each other. At the same time the radiation from opposite side drivers and corresponding waveguides are out of phase, thus providing far field cancellation. This reduces sound spillage from the acoustic device to others who are nearby.

Acoustic device 10 includes right and left button socks or partial housing covers 60 and 62; button socks are sleeves that can define or support aspects of the device's user interface, such as volume buttons 68, power button 74, control button 76, and openings 72 that expose the microphone. When present, the microphone allows the device to be used to conduct phone calls (like a headset). Other buttons, sliders and similar controls can be included as desired. The user interface may be configured and positioned to permit ease of operation by the user. Individual buttons may be uniquely shaped and positioned to permit identification without viewing the buttons. Electronics covers are located below the button socks. Printed circuit boards that carry the hardware that is necessary for the functionality of acoustic device 10, and a battery, are located below the covers.

Housing 13 includes two waveguides, 110 and 160. See FIGS. 7-9. Sound enters each waveguide just behind/underneath a driver, runs down the top side of the neck loop leg on which the driver is located to the end of the leg, turns 180° and down to the bottom side of the housing at the end of the leg, and then runs back up the leg along the bottom side of the housing. The waveguide continues along the bottom side of the first part of the central portion of the neck loop. The waveguide then twists such that at or close to the end of the central portion of the neck loop it is back in the top side of the housing. The waveguide ends at an outlet opening located in the top of the other leg of the neck loop, close to the other driver. The waveguides are formed by the space between the outer wall of the housing and internal integral septum or wall 102. Septum 102 (shown in FIG. 6 apart from the housing) is generally a flat integral internal housing wall that has right leg 130, left leg 138, right end 118, left end 140, and central 180° twist 134. Septum 102 also has curved angled diverters 132 and 136 that direct sound from a waveguide that is running about parallel to the housing axis, up through an outlet opening that is in the top wall of the housing above the diverter, such that the sound is directed generally toward one ear.

Figure 7:
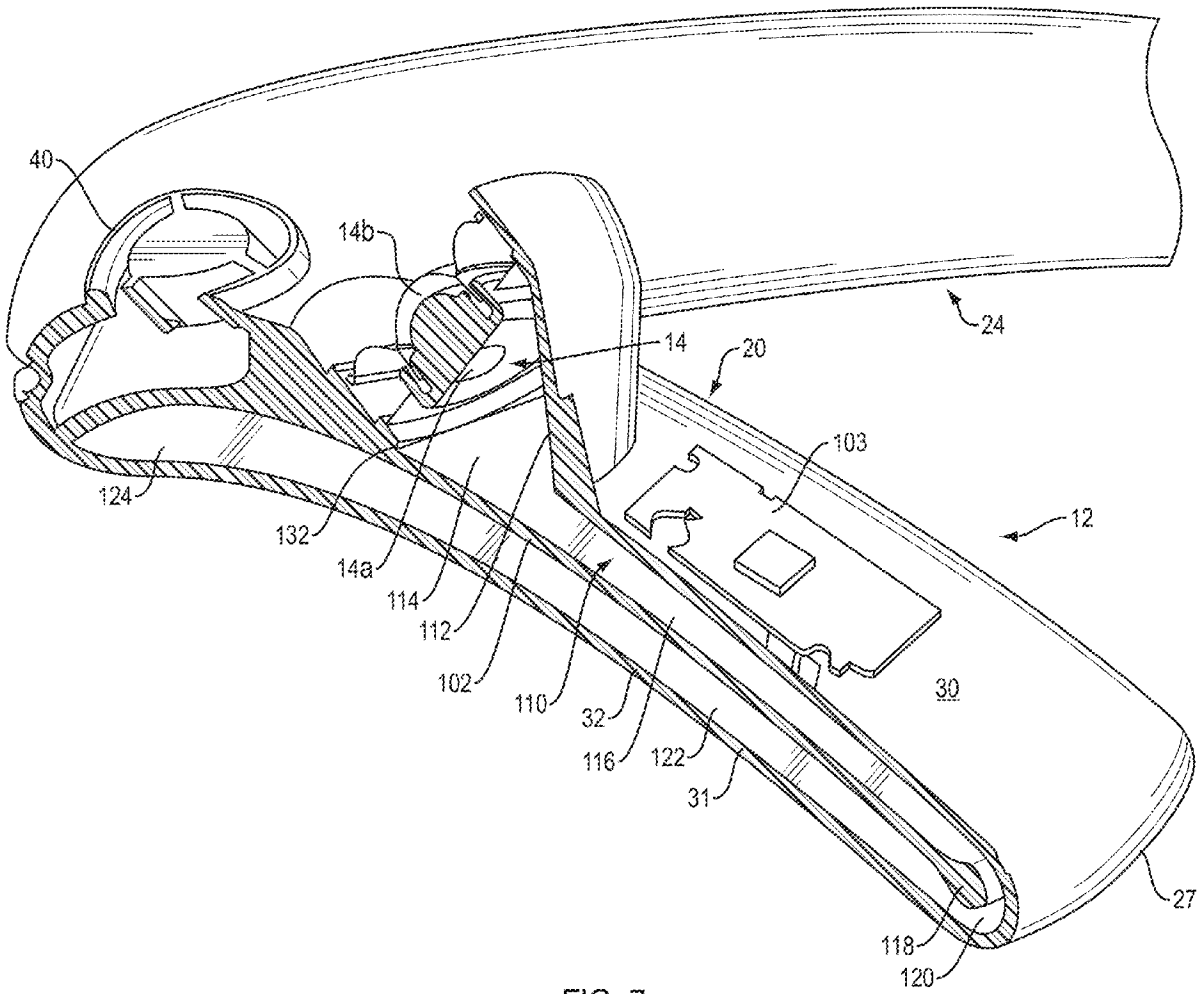
FIG. 7 is a first cross-sectional view of the acoustic device taken along line 7-7 in FIG. 1.
Figure 8:
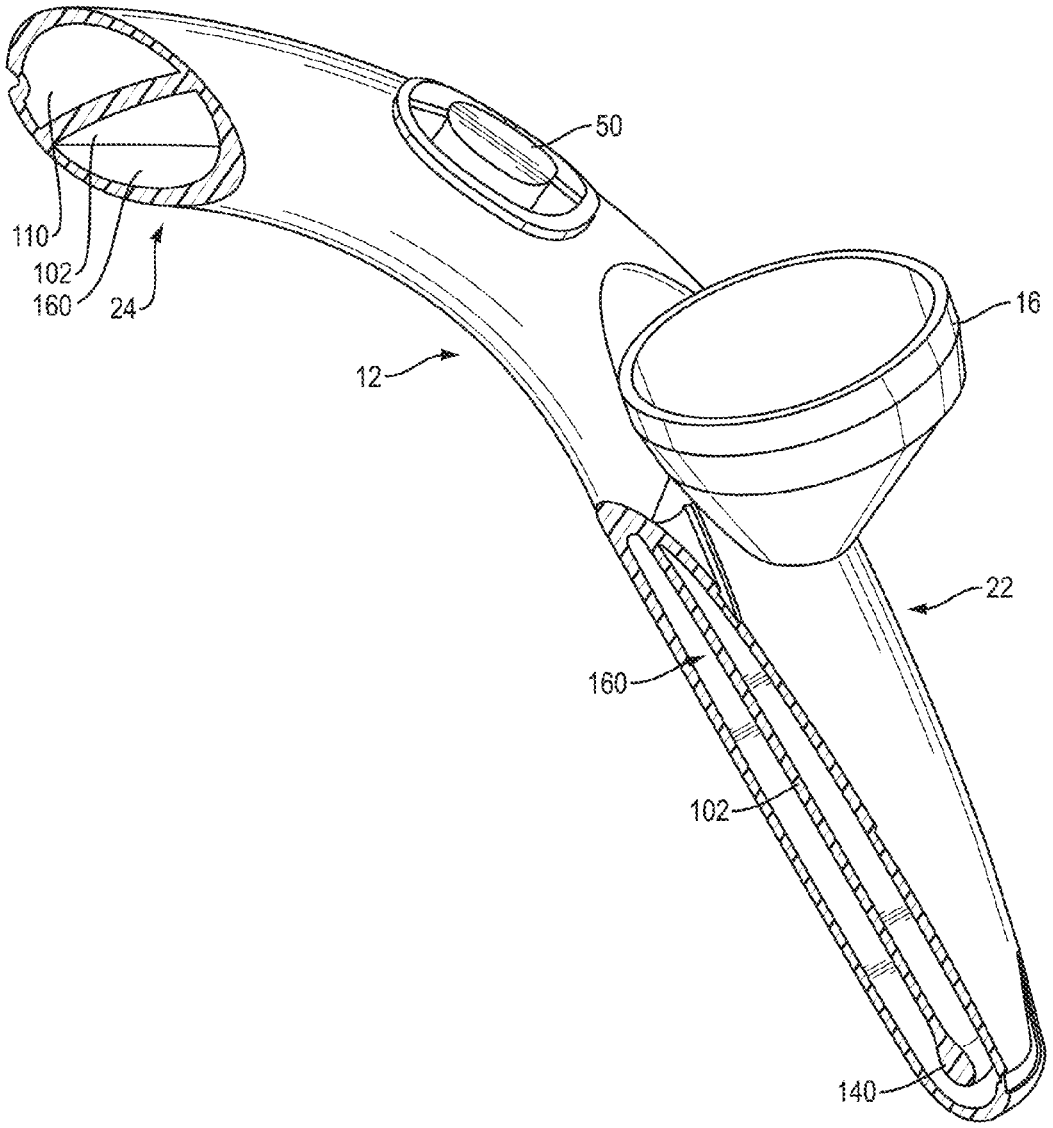
FIG. 8 is a second cross-sectional view of the acoustic device taken along line 8-8 in FIG. 1.
Figure 9:
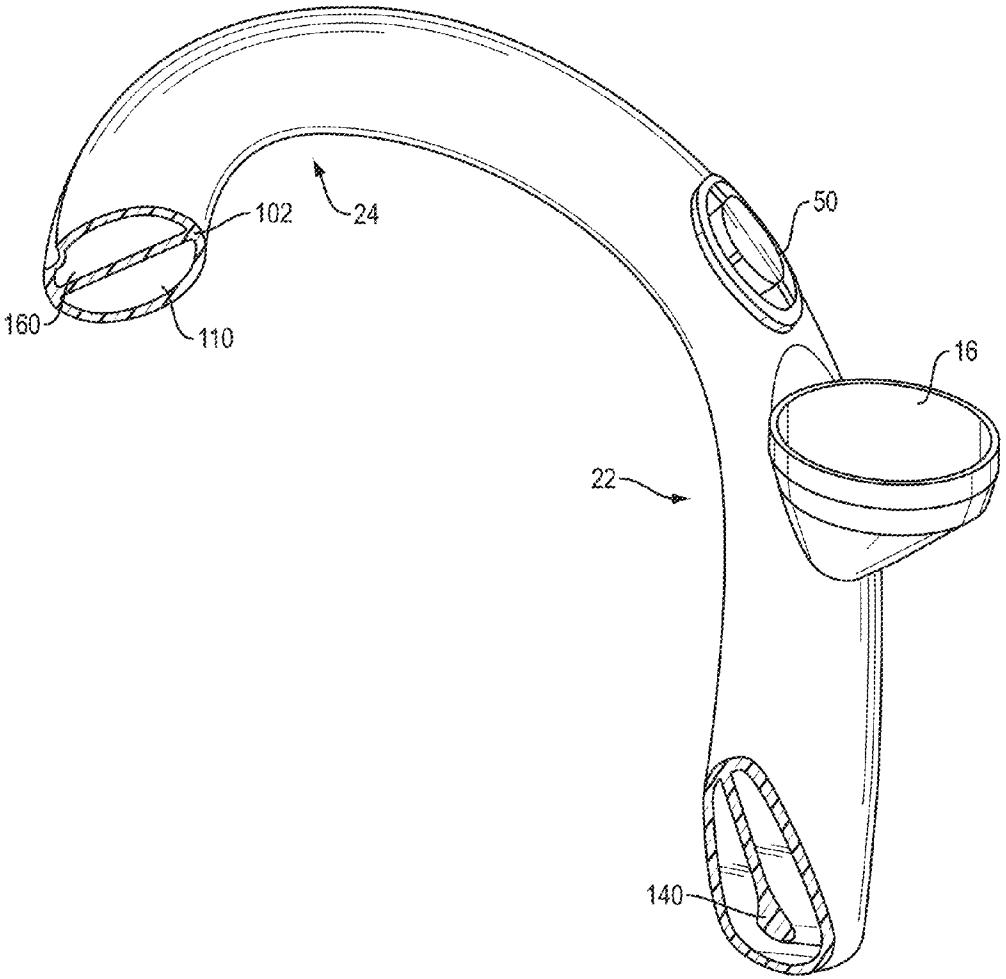
FIG. 9 is a third cross-sectional view of the acoustic device taken along line 9-9 in FIG. 1.

The first part of waveguide 110 is shown in FIG. 7. Waveguide entrance 114 is located directly behind the rear **14*a* of acoustic driver 14, which has a front side 14*b* that is pointed toward the expected location of the right ear. Downward leg 116 of waveguide 110 is located above septum 102 and below upper wall/top 30 of the housing. Turn 120 is defined between end 118 of septum 102 and closed rounded end 27 of housing 12. Waveguide 110 then continues below septum 102 in upward portion 122 of waveguide 110. Waveguide 110 then runs under diverter 133 that is part of septum 102 (see waveguide portion 124), where it turns to run into central housing portion 24. FIGS. 8 and 9 illustrate how the two identical waveguides 110 and 160 run along the central portion of the housing and within it fold or flip over each other so that each waveguide begins and ends in the top portion of the housing. This allows each waveguide to be coupled to the rear of one driver in one leg of the neck loop and have its outlet in the top of the housing in the other leg, near the other driver. FIGS. 8 and 9 also show second end 140 of septum 102, and the arrangement of waveguide 160 which begins behind driver 16, runs down the top of leg 22 where it turns to the bottom of leg 22 and runs up leg 22 into central portion 24. Waveguides 110 and 140** are essentially mirror images of each other.

In one non-limiting example, each waveguide has a generally consistent cross-sectional area along its entire length, including the generally annular outlet opening, of about 2 $cm^2$. In one non-limiting example each waveguide has an overall length in the range of about 22-44 cm; very close to 43 cm in one specific example. In one non-limiting example, the waveguides are sufficiently long to establish resonance at about 150 Hz. More generally, the main dimensions of the acoustic device (e.g., waveguide length and cross-sectional area) are dictated primarily by human ergonomics, while proper acoustic response and functionality is ensured by proper audio signal processing. Other waveguide arrangements, shapes, sizes, and lengths are contemplated within the scope of the present disclosure.

Figure 10:
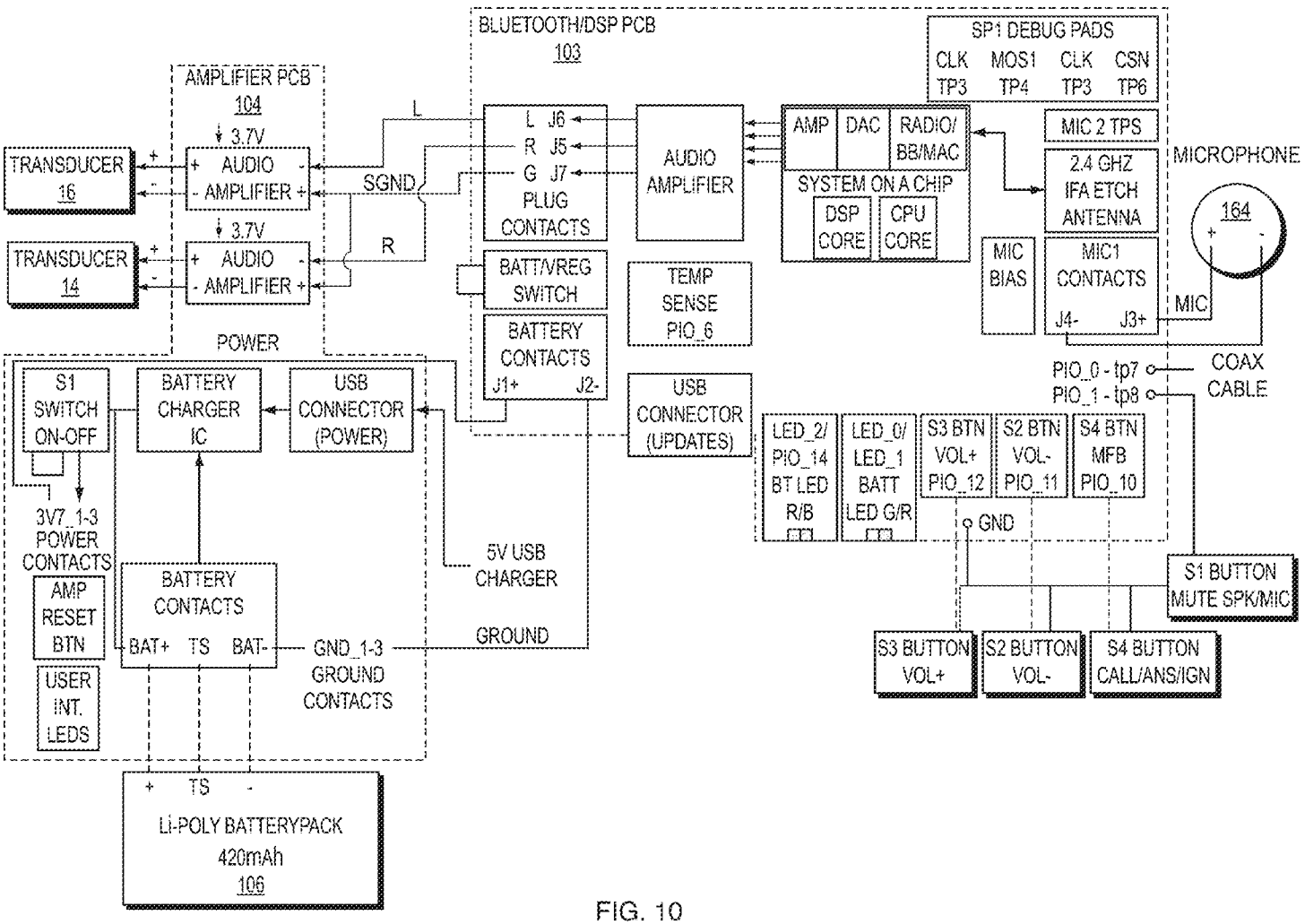
FIG. 10 is a schematic block diagram of the electronics for an acoustic device.

An exemplary but non-limiting example of the electronics for the acoustic device are shown in FIG. 10. In this example the device functions as a wireless headset that can be wirelessly coupled to a smartphone, or a different audio source. PCB 103 carries microphone 164 and mic processing. An antenna receives audio signals (e.g., music) from another device. Bluetooth wireless communication protocol (and/or other wireless protocols) are supported. The user interface can be but need not be carried as portions of both PCB 103 and PCB 104. A system-on-a-chip generates audio signals that are amplified and provided to L and R audio amplifiers on PCB 104. The amplified signals are sent to the left and right transducers (drivers) 16 and 14, which as described above are open-backed acoustic drivers. The acoustic drivers may have a diameter of 40 mm diameter, and a depth of 10 mm, but need not have these dimensions. PCB 104 also carries battery charging circuitry that interfaces with rechargeable battery 106, which supplies all the power for the acoustic device.

Figure 11:
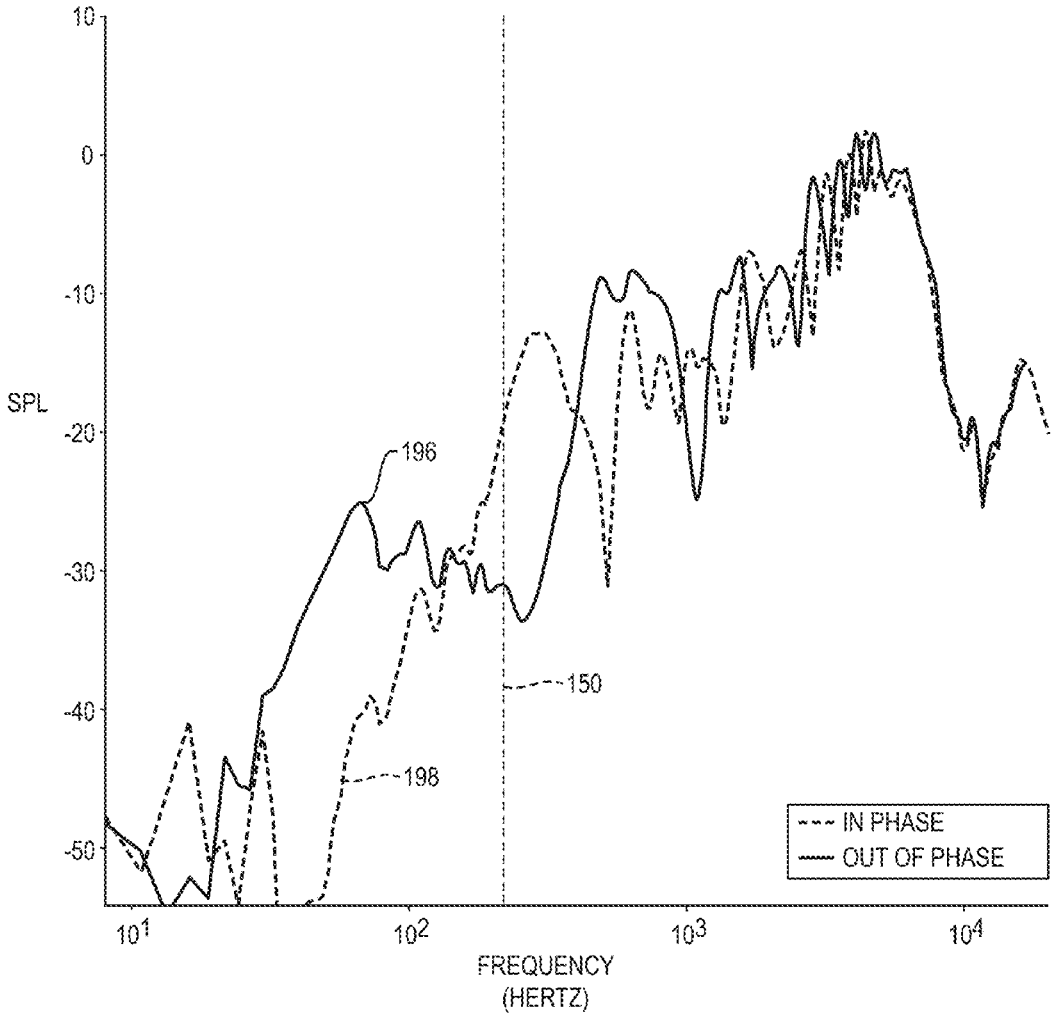
FIG. 11 is a plot of the sound pressure level at an ear of a dummy head, with the drivers of the acoustic device driven both in phase and out of phase.

FIG. 11 illustrates the SPL at one ear with the acoustic device described above. Plot 196 is with the drivers driven out of phase and plot 198 is with the drivers driven in-phase. Below about 150 Hz the out of phase SPL is higher than for in-phase driving. The benefit of out of phase driving is up to 15 dB at the lowest frequencies of 60-70 Hz. The same effect takes place in the frequency range from about 400 to about 950 Hz. In the frequency range 150-400 Hz in-phase SPL is higher than out of phase SPL; in order to obtain the best driver performance in this frequency range the phase difference between left and right channels should be flipped back to zero. In one non-limiting example the phase differences between channels are accomplished using so-called all pass filters having limited phase change slopes. These provide for gradual phase changes rather than abrupt phase changes that may have a detrimental effect on sound reproduction. This allows for the benefits of proper phase selection while assuring power efficiency of the acoustic device. Above 1 KHz, the phase differences between the left and right channels has much less influence on SPL due to the lack of correlation between channels at higher frequencies.

In some cases there is a need to optimize the sound performance of the acoustic device to provide a better experience for the wearer and/or for a person nearby the wearer who may be communicating with the wearer. For example, in a situation where the wearer of the acoustic device is communicating with a person who speaks another language, the acoustic device can be used to provide the wearer with a translation of the other person's speech, and provide the other person with a translation of the wearer's speech. The acoustic device is thus adapted to alternately radiate sound in the near field for the wearer and in the far field for a person close to the wearer (e.g., a person standing in front of the wearer). In the acoustic device, a controller changes the acoustic radiation pattern to produce the preferred sound for both cases. This can be achieved by changing the relative phase of the acoustic transducers in the acoustic device and applying different equalization schemes when outputting sound for the wearer of the acoustic device vs. when outputting sound for another person near the wearer.

For the wearer, the sound field around each ear is important, while far field radiation makes no difference to the wearer but for others close by it is best if the far field radiation is suppressed. For a person listening while standing in front of the wearer the far field sound is important. It is also helpful to a listener if this far field sound has an isotropic acoustic radiation pattern and broad spatial coverage as would be the case if the sound was coming from a human mouth.

Both the near field sound for the wearer and the far field sound for a person close to the wearer can be created by the two acoustic transducers. With the construction described herein (i.e., an acoustic device with an acoustic transducer on each side, each acoustic transducer connected to an outlet on the opposite side of the acoustic device via a waveguide), phase differences between the transducers can be used to create two modes of operation. In a first "private" mode, which may be used, for example, when the acoustic device is translating another person's speech for the wearer of the acoustic device, both transducers are driven out of phase for a first range of frequencies below the waveguide resonant frequency, in phase for a second range of frequencies above the waveguide resonant frequency, and out of phase for a third range of frequencies further above the waveguide resonant frequency. In one non-limiting example where the waveguide resonant frequency is approximately 250 Hz, the relative phase of the acoustic transducers could be controlled as shown in Table 1 below.

TABLE 1

Private Mode Transducer Operation

| Frequency | Transducer A | Transducer B |
|---|---|---|
| <250 Hz | + | − |
| 250-750 Hz | + | + |
| >750 Hz | + | − |

As shown, below about 250 Hz, the transducers are driven out of phase. As previously described, when the transducers are driven out of phase, the two acoustic signals received by each ear are virtually in phase below the waveguide resonance frequency. This ensures that low frequency radiation from each transducer and the same side corresponding waveguide outlet are in phase and do not cancel each other. At the same time, the radiation from opposite side transducers and corresponding waveguides are out of phase, which reduces sound spillage from the acoustic device at these frequencies. Between about 250 and about 750 Hz, the transducers are driven in phase, to increase SPL at the ears of the wearer (see FIG. 11). At these frequencies, sound spillage is not bothersome to a person nearby the acoustic device. Above about 750 Hz, the transducers are driven out of phase, which results in effective sound output at the ears of the wearer (see FIG. 11) and results in some reduction in sound spillage for a person nearby the acoustic device.

The above frequency ranges will vary depending on the waveguide resonant frequency and the desired application. In the case where the acoustic device is being used for translation, the relative phases of the transducers shown above enable effective sound output at the ears of the wearer (see FIG. 11), while reducing sound spillage from the acoustic device to others who are nearby, at least at frequencies where the transducers operate out of phase. The sound can be further optimized for the wearer by applying a near-field equalization scheme. The near-field equalization scheme is designed to optimize the sound for the wearer. It takes into account the fact that sound is emanating from the location near/around the wearer's neck, close to the chest and is received by the wearer's ears.

Figure 12:
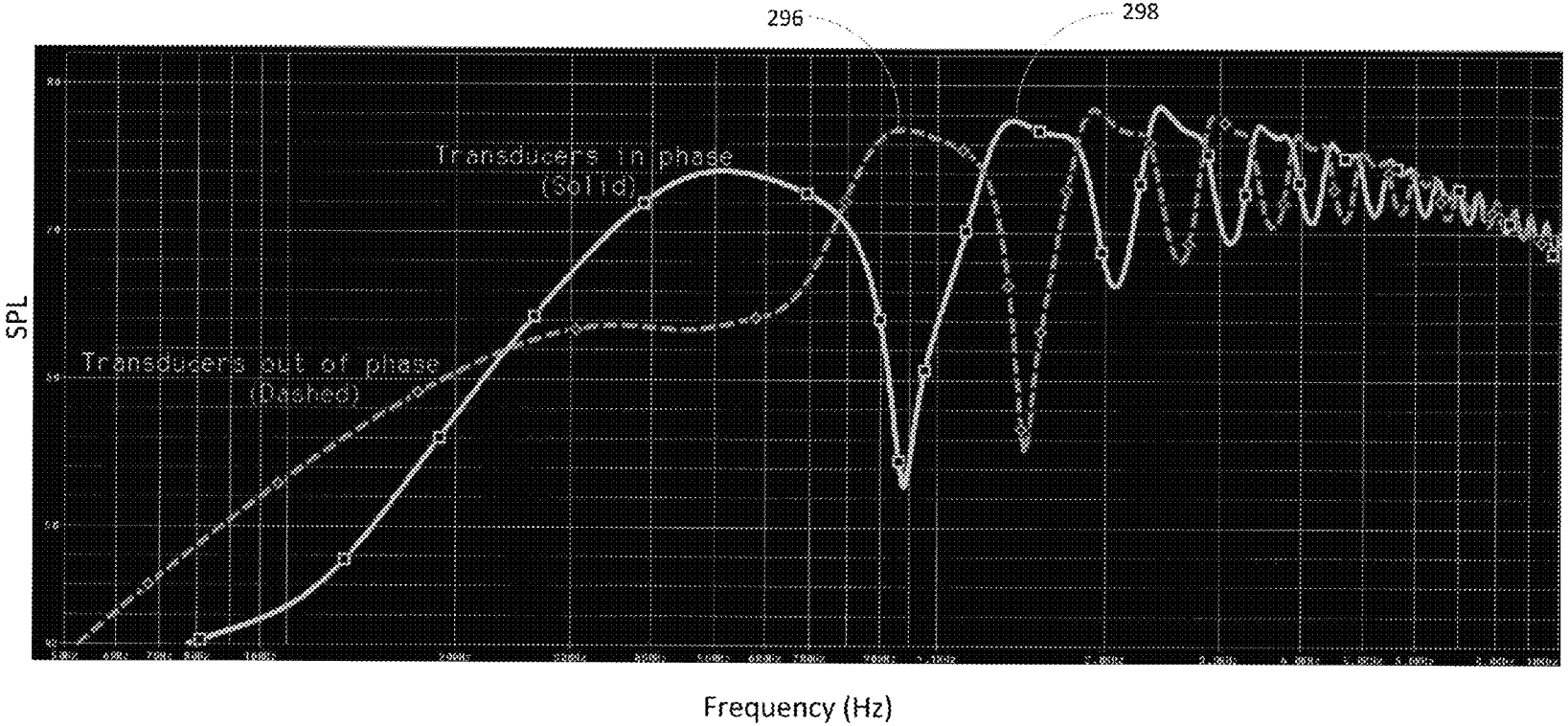
FIG. 12 is a plot illustrating the far field acoustic power radiation with the drivers of the acoustic device driven both in phase and out of phase.

FIG. 12 illustrates the SPL in the far field with the acoustic device described above. Plot 296 is with the acoustic transducers driven out of phase and plot 298 is with the acoustic transducers driven in phase. Below about 250 Hz, the out of phase radiation is greater than the in phase radiation. Above about 250 Hz through about 750 Hz, the in-phase radiation is greater than the out of phase radiation. This ensures that for the speech band, the acoustic device offers efficient voice reproduction for both the wearer and a person nearby the acoustic device.

In a second "out loud" mode, which may be used, for example, when the acoustic device is translating the wearer's speech for another person, both transducers are driven out of phase for a first range of frequencies below the waveguide resonant frequency and in phase for all frequencies at and above the waveguide resonant frequency. In one non-limiting example where the waveguide resonant frequency is approximately 250 Hz, the relative phase of the acoustic transducers could be controlled as shown in Table 2 below.

TABLE 2

| Out Loud Mode Transducer Operation | | |
|---|---|---|
| Frequency | Transducer A | Transducer B |
| <250 Hz | + | − |
| >=250 Hz | + | + |

As shown, below about 250 Hz, the transducers are driven out of phase, which produces the effect described above for the private mode. At frequencies at and above about 750 Hz, the transducers are driven in phase. By designing the waveguides to have a resonant frequency close to the speech band (which typically starts at around 300 Hz), the waveguides are particularly effective for outputting sound in the speech band to both the wearer of the acoustic device and a person nearby the acoustic device. At frequencies greater than the waveguide resonant frequency, the radiation at the waveguide dominates the transducer output, resulting in higher spillage from the acoustic device. In the out loud mode, by operating the transducers in phase for all frequencies in the speech band, the acoustic device maximizes this spillage effect, thereby improving the sound output for a person nearby the acoustic device.

The above frequency ranges will vary depending on the waveguide resonant frequency and the desired application. In the case where the acoustic device is being used for translation, the relative phases of the transducers shown above enable effective sound output for a person nearby the wearer of the acoustic device (see FIG. 12). The sound can be further optimized for the other person by applying a far-field equalization scheme. For example, the equalization scheme may apply a gradual roll off at low frequencies (in some implementations, below 300 Hz) to improve speech intelligibility and power efficiency of the system. The far-field equalization scheme takes into account the fact that sound is emanating from the wearer's body but is perceived by the person standing in front of the wearer, typically in the far field region. Balanced reproduction of the low frequencies is not required for the speech and elimination of such low frequencies allows for a power efficient system operation.

This acoustic design thus achieves an audio system operation in which phase difference between two transducers can either provide the sound to the wearer (with lower spillage to the far field), or sound to the wearer and to the far field with isotropic directivity at lower frequencies.

Figure 13:
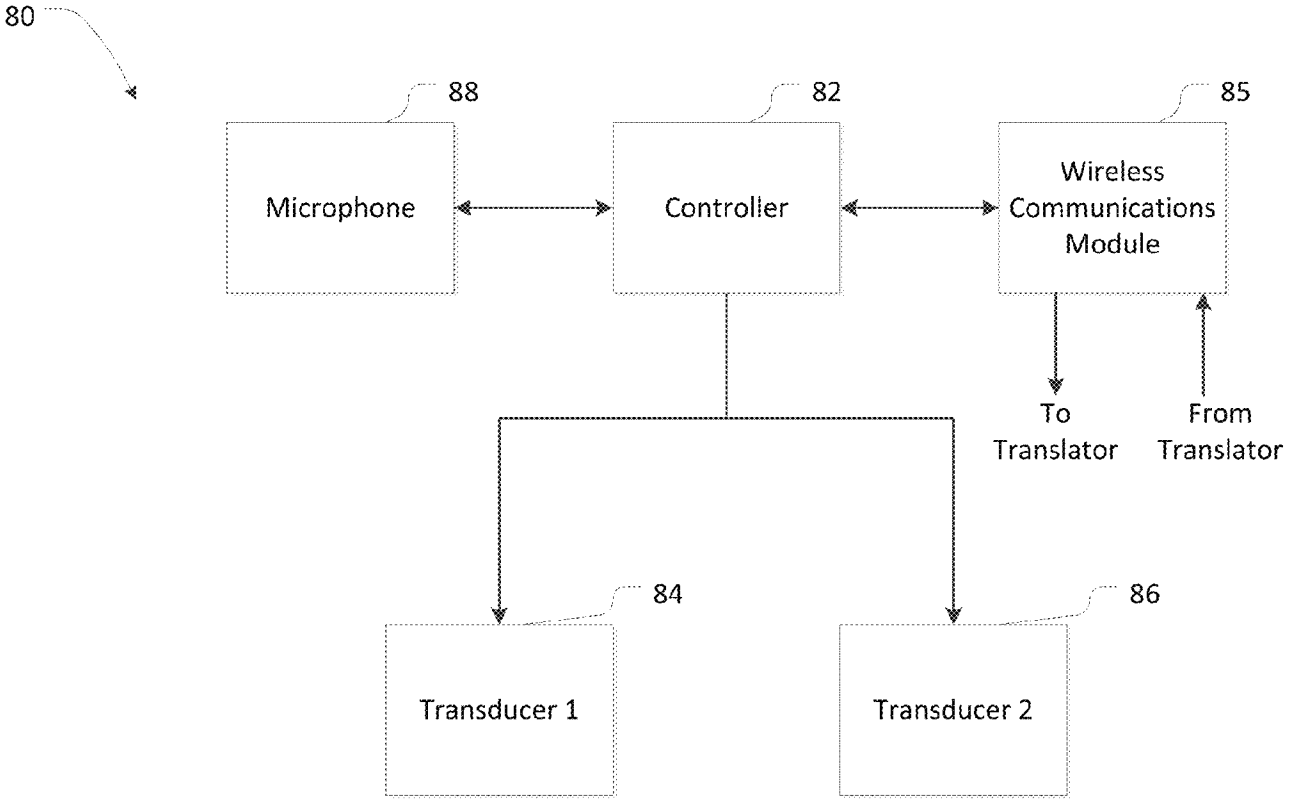
FIG. 13 is a schematic block diagram of elements of an acoustic device.

FIG. 13 is a schematic block diagram of components of one example of an acoustic device of the present disclosure that can be used in translating spoken communication between the acoustic device user and another person. Controller 82 controls the relative phases of first transducer 84 and second transducer 86 at various frequency ranges. Controller 82 also receives an output signal from microphone 88, which can be used to detect speech of the user and another person located close to the user, as explained below. Wireless communications module 85 is adapted to send signals from controller 82 to a translation program (e.g., Google Translate), and receive signals from the translation program and pass them to controller 82. Wireless communications module 85 may be, for example, a Bluetooth® radio (utilizing Bluetooth® or Bluetooth® Low Energy) or may use other communication protocols, such as Near Field Communications (NFC), IEEE 802.11, or other local area network (LAN) or personal area network (PAN) protocols. The translation program may be located in a separate device (e.g., a smartphone) connected to the acoustic device via a wireless connection, or the translation program may be located in a remote server (e.g., the cloud) and the acoustic device may wirelessly transmit signals to the translation program directly or indirectly via a separate connected device (e.g., a smartphone). Controller 82 may establish the two operational modes described herein: a first operational mode (e.g., private mode) where the first and second acoustic transducers 84 and 86 are operated out of phase for a first range of frequencies below the waveguide resonant frequency, in phase for a second range of frequencies above the waveguide resonant frequency, and out of phase for a third range of frequencies further above the waveguide resonant frequency; and a second operational mode (e.g., out loud mode) where the first and second acoustic transducers 84 and 86 are operated out of phase for a first range of frequencies below the waveguide resonant frequency and in phase for all frequencies at and above the waveguide resonant frequency. Controller 82 may enable the first operational mode in response to the user speaking, and controller 82 may enable the second operational mode in response to a person other than the user speaking.

The selection of the mode can done automatically by one or more microphones (either on board the acoustic device or in a connected device) that detect where the sound is coming from (i.e. the wearer or another person) or by an application residing in a smartphone connected to the acoustic device via a wired or wireless connection based on the content of the speech (language recognition), or by manipulation of a user interface, for example.

As described above, transitioning the transducers to a different phase can be accomplished through all pass filters having limited phase change slopes, which provide for gradual phase changes (rather than abrupt phase changes) to minimize any impact on sound reproduction.

The controller element of FIG. 13 is shown and described as a discrete element in a block diagram. It may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

Figure 14:
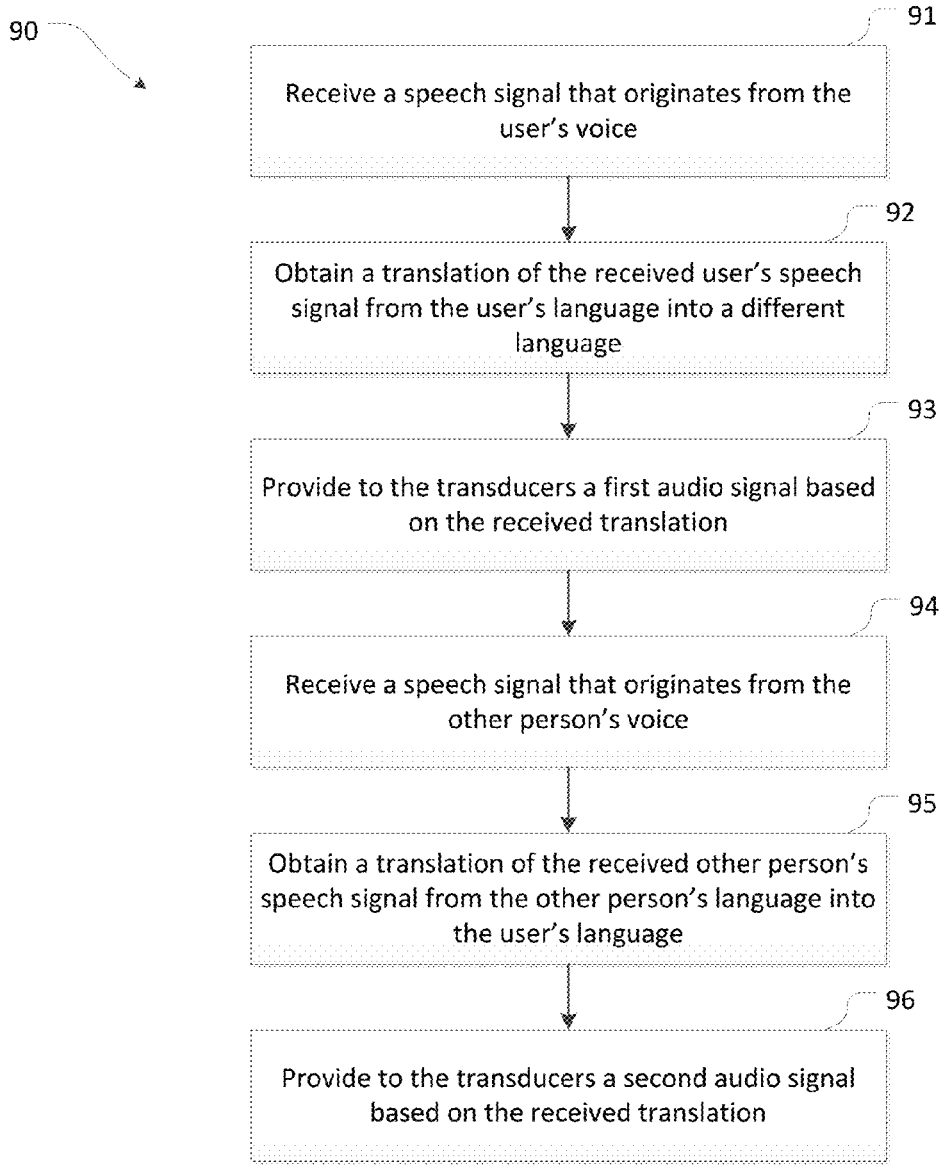
FIG. 14 illustrates steps of a method of controlling an acoustic device to assist with a communication between two people.

A method 90 of controlling an acoustic device to assist with oral communication between a device user and another person is set forth in FIG. 14. Method 90 contemplates the use of an acoustic device such as those described above. In one non-limiting example the acoustic device can have first and second acoustic transducers each acoustically coupled to a waveguide proximate an end of the waveguides, and wherein the first and second acoustic transducers are each further arranged to project sound outwardly from the waveguide (see, e.g., FIG. 1). In method 90, a speech signal that originates from the user's voice is received, step 91. The speech signal can be detected by a microphone carried by the acoustic device, with the microphone output provided to the controller. Alternatively, the speech signals can be detected by a microphone integral to a device connected (via a wired or wireless connection) to the acoustic device. A translation of the received user's speech from the user's language into a different language is then obtained, step 92. In one non-limiting example, the present acoustic device can communicate with a portable computing device such as a smartphone, and the smartphone can be involved in obtaining the translation. For example, the smartphone may be enabled to obtain translations from an internet translation site such as Google Translate. The controller can use the translation as the basis for an audio signal that is provided to the two transducers, step 93. In the example described above, the translation can be played by the transducers out of phase for a first range of frequencies below the waveguide resonant frequency and in phase for all frequencies at and above the waveguide resonant frequency. This allows a person close to the user to hear the translated speech signal.

In step 94, a (second) speech signal that originates from the other person's voice is received. A translation of the received other person's speech from the other person's language into the user's language is then obtained, step 95. A second audio signal that is based on this received translation is provided to the transducers, step 96. In the example described above, the translation can be played by the transducers out of phase for a first range of frequencies below the waveguide resonant frequency, in phase for a second range of frequencies above the waveguide resonant frequency, and out of phase for a third range of frequencies further above the waveguide resonant frequency. This allows the wearer of the acoustic device to hear the translation, while reducing spillage at least at some frequencies for the person communicating with the wearer.

Method 90 operates such that the wearer of the acoustic device can speak normally, the speech is detected and translated into a selected language (typically, the language of the other person with whom the user is speaking). The acoustic device then plays the translation such that it can be heard by the person with whom the user is speaking. Then, when the other person speaks the speech is detected and translated into the wearer's language. The acoustic device then plays this translation such that it can be heard by the wearer, but is less audible to the other person (or third parties who are in the same vicinity). The device thus allows relatively private, translated communications between two people who do not speak the same language.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An audio device comprising:

a housing comprising a first acoustic waveguide having a first sound outlet opening, and a second acoustic waveguide having a second sound outlet opening;

a first acoustic transducer acoustically coupled to the first waveguide;

a second acoustic transducer acoustically coupled to the second waveguide; and a controller that controls the relative phases of the first and second acoustic transducers;

wherein the controller establishes two operational modes comprising:

a first operational mode wherein the first and second acoustic transducers are out of phase in a first frequency range, in phase in a second frequency range, and out of phase in a third frequency range; and a second operational mode wherein the first and second acoustic transducers are out of phase in the first frequency range, and in phase in the second and third frequency ranges.

2. The audio device of claim 1, wherein the first sound outlet opening is proximate to a first end of the first acoustic waveguide, and the second sound outlet opening is proximate to a first end of the second acoustic waveguide.

3. The audio device of claim 2, wherein the first acoustic transducer is proximate to a second end of the first acoustic waveguide, and the second acoustic transducer is proximate to a second end of the second acoustic waveguide.

4. The audio device of claim 1, wherein the housing is configured to be worn around a user's neck.

5. The audio device of claim 1, wherein the controller enables the first operational mode in response to the user speaking.

6. The audio device of claim 1, wherein the controller enables the second operational mode in response to a person other than the user speaking.

7. The audio device of claim 1, wherein the first frequency range is below the resonant frequency of the first and second waveguides.

8. The audio device of claim 1, further comprising a microphone configured to receive voice signals from at least one of: the user and a person other than the user.

9. The audio device of claim 8, further comprising a wireless communication module for wirelessly transmitting the voice signals to a translation engine.

10. The audio device of claim 9, wherein the translation engine translates the voice signals to another language.

11. The audio device of claim 1, wherein the controller is further configured to apply a first equalization scheme to audio signals output via the first and second transducers during the first operational mode, and apply a second equalization scheme to audio signals output via the first and second transducers during the second operational mode.

12. A computer-implemented method of controlling an audio device to assist with oral communication between a device user and another person, wherein the audio device comprises a housing comprising a first acoustic waveguide having a first sound outlet opening, and a second acoustic waveguide having a second sound outlet opening, and first and second acoustic transducers, wherein the first acoustic transducer is acoustically coupled to the first waveguide, and the second acoustic transducer is acoustically coupled to the second waveguide, the method comprising:

receiving a voice signal associated with the user;

generating a first audio signal that is based on the received user's voice signal;

outputting the first audio signal from the first and second acoustic transducers, wherein the first and second acoustic transducers are operated out of phase in a first frequency range, in phase in a second frequency range, and out of phase in a third frequency range;

receiving a voice signal associated with the other person;

generating a second audio signal that is based on the received other person's voice; and outputting the second audio signal from the first and second acoustic transducers, wherein the first and second acoustic transducers are operated out of phase in the first frequency range, and in phase in the second and third frequency ranges.

13. The method of claim 12, further comprising obtaining a translation of the received user's voice signal from the user's language into a different language, and wherein the first audio signal is based on the translation.

14. The method of claim 12, further comprising obtaining a translation of the received other person's voice signal from the other person's language into the user's language, and wherein the second audio signal is based on the translation.

15. The method of claim 12, further comprising wirelessly transmitting the received user's voice signal to a secondary device, and using information from the secondary device to generate the first audio signal.

16. The method of claim 12, further comprising wirelessly transmitting the received other person's voice signal to a secondary device, and using information from the secondary device to generate the second audio signal.

17. The method of claim 12, further comprising applying a first equalization scheme to the first audio signal, and applying a second equalization scheme to the second audio signal.

18. A machine-readable storage device having encoded thereon computer readable instructions for causing one or more processors to perform operations comprising:

receiving a voice signal associated with a user of an audio device;

generating a first audio signal that is based on the received user's voice signal;

outputting the first audio signal from first and second acoustic transducers supported by a housing of the audio device, wherein the first and second acoustic transducers are operated out of phase in a first frequency range, in phase in a second frequency range, and out of phase in a third frequency range;

receiving a voice signal associated with a person other than the user;

generating a second audio signal that is based on the received other person's voice; and outputting the second audio signal from the first and second acoustic transducers, wherein the first and second acoustic transducers are operated out of phase in the first frequency range, and in phase in the second and third frequency ranges.

19. The machine-readable storage device of claim 18, wherein the operations further comprise:

obtaining a translation of the received user's voice signal from the user's language into a different language, and wherein the first audio signal is based on the translation; and obtaining a translation of the received other person's voice signal from the other person's language into the user's language, and wherein the second audio signal is based on the translation.

* * * * *